United States Patent [19]

Bradford et al.

[11] 4,136,493

[45] Jan. 30, 1979

[54] SUPPORTING STRUCTURE FOR CONTAINERS USED IN STORING LIQUEFIED GAS

[75] Inventors: Rolland H. Bradford, Tucson, Ariz.; Paul V. Laylander, Irvine; Anthony J. Baranyi, Costa Mesa, both of Calif.

[73] Assignee: NRG Incorporated, Phoenix, Ariz.

[21] Appl. No.: 724,805

[22] Filed: Sep. 20, 1976

Related U.S. Application Data

[63] Continuation of Ser. No. 579,870, May 22, 1975, abandoned.

[51] Int. Cl.[2] ..... B63B 25/12; F17C 7/02

[52] U.S. Cl. ..... 52/169.7; 52/249; 52/274; 52/404; 62/45; 405/55; 220/429

[58] Field of Search ..... 52/169, 274, 249, 404; 61/0.5, 36; 62/45; 220/9 LG, 15

[56] References Cited

U.S. PATENT DOCUMENTS

| | | | |
|---|---|---|---|
| 3,092,933 | 6/1963 | Closner et al. | 52/169 X |
| 3,118,194 | 1/1964 | Biais | 220/9 LG |
| 3,267,680 | 8/1966 | Schlumberger | 61/0.5 |
| 3,274,785 | 9/1966 | Lange | 52/169 X |
| 3,326,011 | 6/1967 | Sparling | 61/0.5 X |
| 3,688,938 | 9/1972 | Yamamoto et al. | 220/9 LG |
| 3,701,262 | 10/1972 | Connell | 62/45 |
| 3,926,134 | 12/1975 | Closner et al. | 220/9 LG |

FOREIGN PATENT DOCUMENTS

| | | | |
|---|---|---|---|
| 1959665 | 6/1971 | Fed. Rep. of Germany | 62/45 |

*Primary Examiner*—J. Karl Bell

*Attorney, Agent, or Firm*—Knobbe, Martens, Olson, Hubbard & Bear

[57] ABSTRACT

Liquefied gas is stored in a large rigid or semirigid cylindrical container. Between the walls and floor of this container and the walls and floor of an outer container, which may be an earthen cavity in which the container rests, is distributed a continuous layer of insulating material such as perlite or vermiculite in granular form. This insulating material serves as the sole means of support for the rigid or semirigid container and the liquefied gas stored therein. An impediment is included in the construction near the intersection of the floor and side wall of the rigid or semirigid container, the impediment completely encircling the container to substantially limit the cross-sectional area through which the granular insulation material may flow upward. By confining this cross-sectional area, the creep or migration of insulation material from beneath the container during initial filling, repeated filling and emptying of the liquefied gas contents of said container is substantially reduced or eliminated.

16 Claims, 6 Drawing Figures

37
33
47
39
55
27
41
57
29
31
25
21
43
11
13
15
2
50
17
19
50
2
49
45
23
21
45

50
50
45
15
17
1
19
1
45
13
54
11
49
50
50

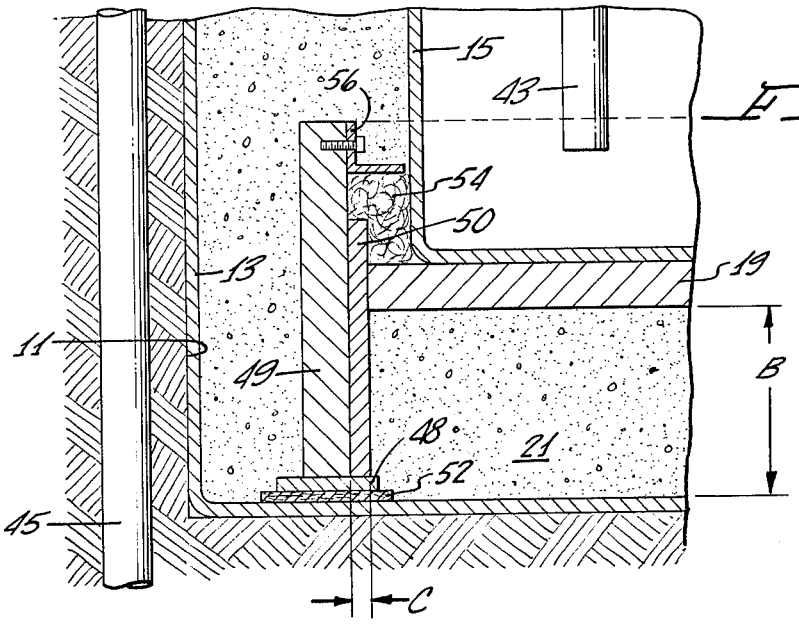
FIG. 3
FIG. 4
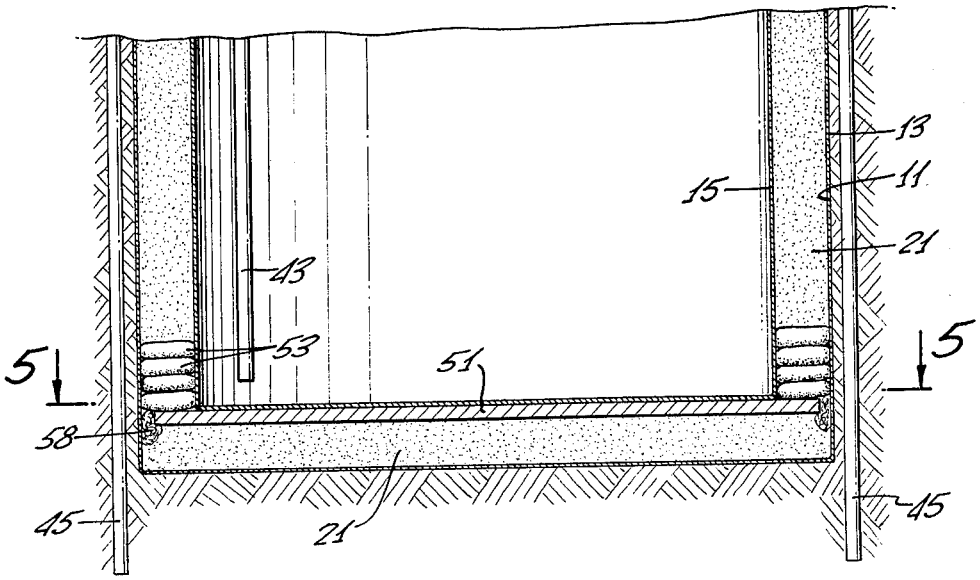

SUPPORTING STRUCTURE FOR CONTAINERS USED IN STORING LIQUEFIED GAS

This is a continuation, of application. Ser. No. 579,870, filed May 22, 1975 now abandoned.

BACKGROUND OF THE INVENTION

The present invention relates to the storage of large quantities of liquefied gas, most advantageously natural gas, in a rigid or semirigid storage vessel which, in a typical embodiment, is located underground, but may also conveniently be located above ground.

Three different concepts have been utilized in existing cryogenic liquefied gas storage systems. These concepts have respectively involved the use of above-ground tanks, below-ground tanks, and in-ground storage. In-ground tanks, that is, those which store liquefied natural gas directly in a frozen hole in the ground, typically use the earth itself as a liquid container. In a few instances, a flexible, moisture-impervious liner has been incorporated. Although the heat leak into these tanks is usually excessive, a few of them have enjoyed limited success. A principal problem with this approach is that the success or failure of the project depends almost entirely on the effect the cryogenic temperatures have on the soil or rock formation in which the container is constructed. In many cases, subjecting the soil or rock to cryogenic temperatures results in fracture and fissure formations which increase the heat leak to the point where the tank is not usable and must be abandoned.

For this reason, most tanks are constructed either above ground, as by forming a concrete or metallic outer tank structure with a metal inner tank structure separated from the outer tank by a liner of insulation; or underground, as by fabricating tanks submerged wholly or partially in the ground. In above-ground vessels of this prior art type, the outer tank may or may not have an independent floor member, as dictated by construction practicalities. In such installations, a void may be left between the tank and the surface of the ground, which void may be filled with insulation. Alternatively, a second, inner tank may be spaced from the outer tank, and the void therebetween may be filled with insulation. In each case where an inner tank, used for storing liquefied gas, is separated from an outer container, either a second tank or the surface of an excavation, supporting structure such as peirs have been used to support the inner tank above the level of the excavation floor or the floor of the outer tank. These piers thus elevate the inner tank to produce a void which may be filled with insulation material. While the use of such insulation material substantially improves the quality of the storage tank by limiting heat leaking into the floor of the liquefied gas storage vessel, the use of piers or other rigid supporting structures presents a substantial heat leak problem. Thus, heat flows directly from the ground below the excavation and through the support structure in underground tanks. Similarly, heat flows through the supporting structure into the liquefied gas from the underlying ground surface in above-ground tanks. An installation which avoids this inherent difficulty is described in U.S. Pat. No. 3,701,262 entitled "MEANS FOR THE UNDERGROUND STORAGE OF LIQUEFIED GAS," issued to Joseph A. Connell and Anthony J. Baranyi and assigned to the assignee of the present invention. In the storage system described in that patent, an excavation in the ground is lined with a flexible, impervious liner, and insulation such as granular perlite is placed in bags which are stacked on the floor and against the walls of this lined excavation. A second flexible, impervious liner is then placed against the bagged insulation and is used to directly store the liquefied gas. Since this inner liner is flexible and conforms to the bagged perlite, the perlite is not permitted to creep or migrate from beneath the storage vessel. In some installations, however, as for example where excessive earth movement would place excessive stress upon a flexible inner liner, a rigid or semirigid interior tank is required.

In installations such as that shown in patent 3,701,262, it is desired to have sufficient insulation between an inner and outer tank or wall to permit control of the thickness of a frozen wall of earth surrounding the tank. The use of piers or columns for supporting a semirigid inner tank would interfere with this control, since it would cause substantial freezing of the earth beneath the tank which could not be adequately controlled.

SUMMARY OF THE INVENTION

The present invention, in order to overcome the difficulty of supporting a rigid or semirigid inner tank in a liquefied gas storage container, either above or below ground, utilizes a granular insulation material such as perlite or vermiculite as the sole means of vertical support for the inner tank structure. This invention applies to large storage vessels, such as those having a diameter in excess of 10 feet. Such insulation material is typically subject to compression and expansion when the tank is initially filled, repeatedly filled and emptied with liquefied gas, and this compression and expansion may lead to a migration or creep of the insulation material underlying the tank. During the initial loadings, this compression may be substantial, but the degree of compression is reduced, and eventually becomes minimal, with repeated loadings, when compression occurs, insulation material may creep from beneath the tank to the area between the side walls of the inner and outer tank structures, thus permitting the tank to settle, perhaps unevenly. In order to limit this migration, the present invention utilizes an impediment between the inner and outer tank walls, situated at the junction of the floor of the inner tank and the side walls thereof. This impediment may take two primary configurations.

The first configuration is a circular ring, slightly larger in diameter than the inner tank or the platform supporting this tank. This ring surrounds the inner tank, but is spaced from the inner tank to permit insulation between each element. This ring rests, typically on a pad of insulating material, on the floor of the outer container or excavation and acts as a cylinder within which the inner tank or its platform may reciprocate in piston fashion, the distance between the inner tank and the ring being confined or filled with nongranular insulation to limit migration of the granular supporting material.

The second configuration of the present invention utilizes an extended floor or platform beneath the floor of the inner tank which is spaced from the wall of the outer tank. This space is filled with nongranular insulation material to prohibit migration of perlite from the bottom of the tank to the sides thereof. The platform in this embodiment is preferably constructed of rigid material. In this embodiment, the tank platform or extended base of the tank operates as a piston within the outer tank or excavation.

In addition to these embodiments, a method of initially loading this tank structure is disclosed, which method prohibits nonuniform initial compaction of the insulation material which, without such limitation, would cause the rigid or semirigid inner tank to distort or situate itself unevenly within the outer excavation or tank. This method includes the gradual initial loading of the inner tank with a fluid, such as water, and the monitoring of the settling thereby induced in the inner tank to assure that the floor of the rigid or semirigid tank is maintained level during this settling operation. If more settling occurs at one side of the tank than the other, indicating the initiation of a tilting trend, supporting structure or cabling may be used to prevent further settling of the lower side of the floor in order to once again level the inner tank. This initial preloading may be accomplished before construction of the inner tank is complete. It has been found that, once the inner tank has been subjected to full load and has therefore settled to its maximum extent in this preload operation, subsequent filling and emptying of the inner tank will not cause uneven settling of the insulation. Furthermore, after an initial series of precompressions, migration of the granular material from one side of the tank floor to the other or from the tank floor to the tank wall is essentially prohibited, so long as the impediments of the present invention are included. The tank will therefore remain level during loading and unloading throughout its useful life.

These and other advantages of the present invention are best understood through a reference to the drawings in which:

FIG. 3 is an enlarged portion of the cross-sectional view of FIG. 1 showing the area adjacent the intersection of the floor and wall of the liquid storage tank;

FIG. 4 is a sectional view similar to that of FIG. 1 taken along lines 4—4 of FIG. 5 showing an alternate embodiment of the present invention;

DETAILED DESCRIPTION OF THE PREFERRED EMBODIMENT

Figure 1:
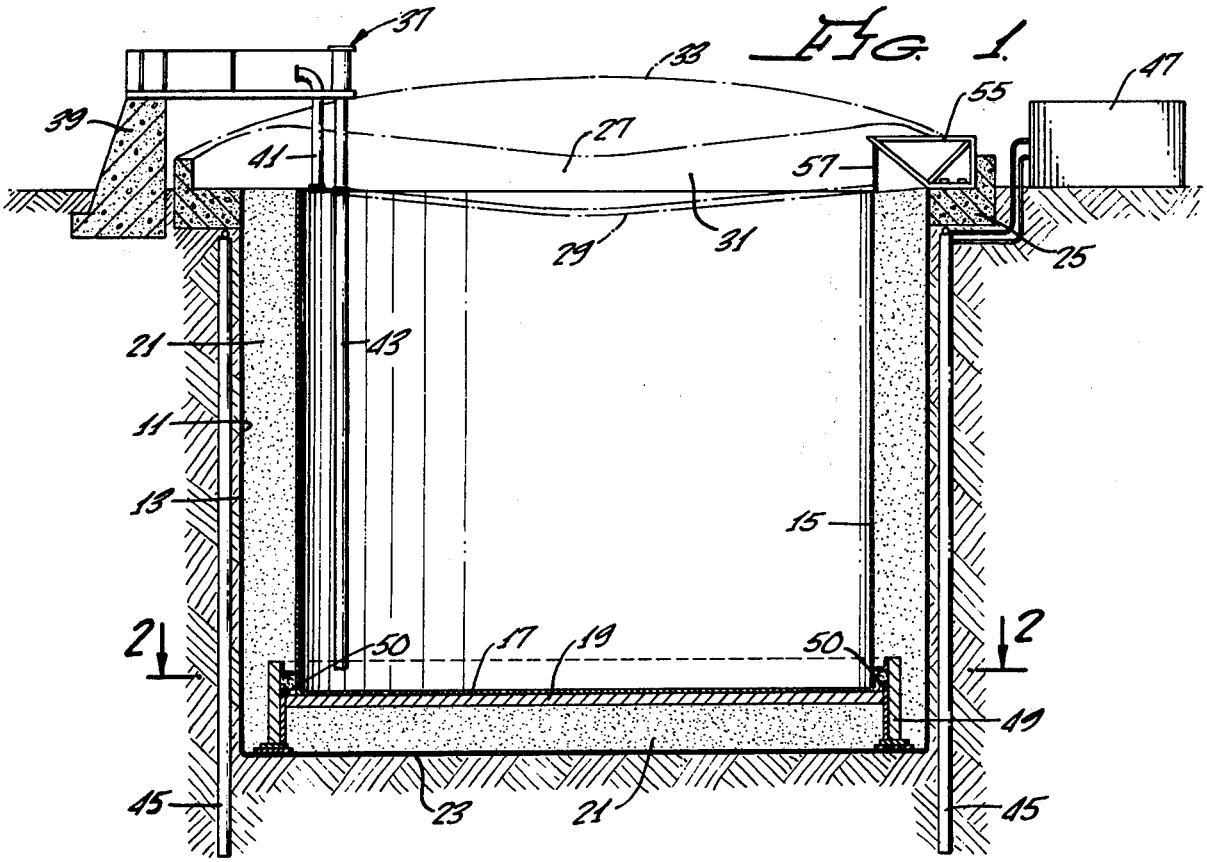
FIG. 1 is a cross-sectional view, taken vertically through an underground tank installation, taken along lines 1—1 of FIG. 2, showing the supporting structure of the present invention.
Figure 2:
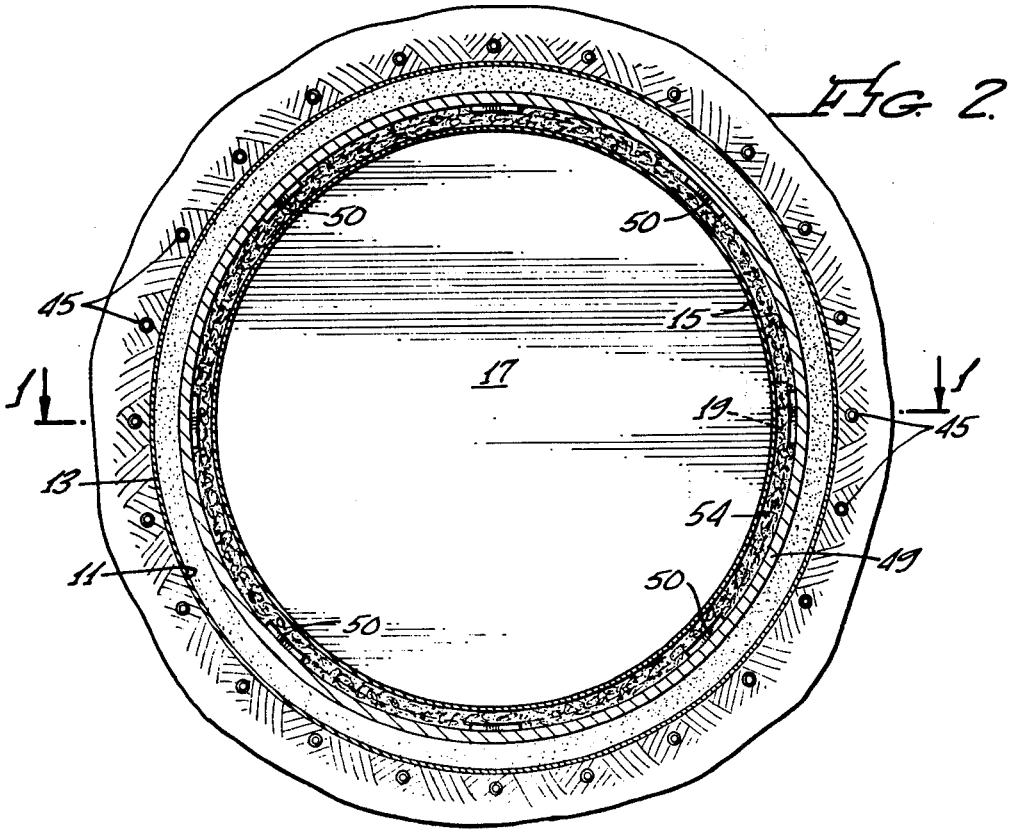
FIG. 2 is a horizontal sectional view taken along lines 2—2 of FIG. 1.

Referring initially to FIGS. 1 through 3, a typical overall tank structure which may incorporate the support system of the present invention will be disclosed. This tank structure may be essentially identical to the tank structure which is disclosed in U.S. Pat. No. 3,701,262 and the disclosure of that patent is incorporated herein by reference. The essential difference between the structure of FIG. 1 and that disclosed in U.S. Pat. 3,701,262 is the replacement of a flexible inner liner with a rigid or a semirigid inner tank structure, and the utilization of an underlying platform for this inner tank, as will be described more fully below.

The storage tank is shown to be fabricated in an opening 11 in the earth's surface which houses a bucket-shaped liner 13 which is moisture-impervious and serves to prevent moisture from the earth from seeping into the thermal installation. Within the bucket-shaped liner 13 and spaced therefrom is a rigid or semirigid inner tank structure 15 which is typically constructed from metal sheet material in the form of a cylinder having a rigid base portion 17. The inner tank structure 15 may include reinforcing girders, either interior or exterior to the metal sheet material, to make the tank 15 as rigid as possible. Underlying the base portion 17 is a rigid platform 19 which is utilized to distribute the weight beneath the tank 15 onto the supporting insulation and to prohibit a buckling of the bottom wall 17 of the container 15. The void between the cylindrical wall of the container 15 and the excavation wall 13 is filled with granular insulation material, such as granular perlite or vermiculite 21. This same insulation material is utilized between the platform 19 and the bottom 23 of the excavation 11.

A concrete ring 25 surrounds the lip of the opening 11 and serves as a structural support for a ceiling 27. This ceiling 27 is shown in broken lines, since it is installed after preloading of the tank 15, as will be explained below. The ceiling 27 could include, for example, the ceiling structure shown in U.S. Pat. No. 3,701,262 which includes a net of cables 29 upon which a layer of granular insulation material 31 is distributed. Alternatively, the cables 29 may be replaced by any other insulated roof structure, many of which are standard in the art. If desired, a roof 33 supported by an inert gas, such as nitrogen, may be anchored upon the ring 25 to prevent damage to the ceiling 27. It should be understood that the roof structure is not critical to this invention.

Cryogenic fluid is pumped into and out of the storage tank by a typical pumping system 37 which is suspended into the storage tank from a cantilever support structure 39. The pumping system 37 will typically include a fill line 41 and a discharge line 43, the latter being submerged within the tank to a location adjacent the bottom wall 17 thereof.

As described in U.S. Pat. No. 3,701,262, the storage tank of FIG. 1 may be either in an opening which is in a rock formation, in which case freezing of the ground is not required, or it may be formed in an opening in the soil, in which case it is desirable that the ground be frozen, both as an aid in construction and to provide structural strength during operation of the tank. The tank which is illustrated in FIG. 1 is of the latter type.

This type of tank is constructed by inserting freeze pipes 45 into the ground in a circle which will ultimately be the center of a frozen earthen wall. A refrigeration system 47 is utilized to pump a refrigerant into the pipes 45 prior to excavation.

After the walls have been frozen to the desired thickness, excavation of the unfrozen center of the frozen ring by any of several known methods may begin. After the excavation has progressed to a depth which will represent the bottom of the earthen wall 11, heat exchanger pipes (not shown) may be laid along the bottom horizontal wall of the excavation 11 to maintain this portion of the wall frozen during use of the container.

The installation of the tank is now accomplished by first smoothing the earthen wall 11. A layer of padding (not shown) is placed over the wall 11 and the outer bucket-shaped liner 13 is either lowered into the opening or constructed in place. This bucket-shaped liner 13 is preferably shaped to conform to the shape of the opening 13 and may have a size which is slightly larger than the opening to preclude the possibility of being placed in tension when the tank is filled. The liner 13 may additionally be supported at vertical intervals, if desired. The top of the outer liner 13 is anchored to the concrete ring 25.

With the outer line 13 in place, a rigid cylindrical ring 49 is lowered into the excavation, or constructed in place. The ring 49 includes a lower support flange 48 which distributes the weight of the ring 49. A layer of padding 52 may be placed between the flange 48 and the liner 13 to protect the liner 13 from puncture or abrasion. The padding 52 may consist of granular insulation material, packed in bags to prevent migration from beneath the flange 48.

Attached at periodic intervals around the inner surface of the ring 49 are a plurality of spacer ribs 50 which maintains the platform 19 spaced from the ring 49. As will be explained below, the platform 19 reciprocates vertically within the ring 49 during the initial loading of the tank 15, and the spacers 50 must be positioned on the ring 49 and have sufficient vertical length to maintain the platform 19 spaced from the ring 49 throughout the reciprocating range of the platform 19.

The ring 49, flange 48 and spacer ribs 50 may be constructed of any rigid, cryogenically stable material, and are typically aluminum. These elements are rigidly fastened together as by weldments or bolts. The circumferential dimension of the spacer ribs 50 is kept at a minimum, consistent with structural requirements, to limit the heat leak from the platform 19 into the ring 49, and is typically less than four inches. The spacer ribs 50 thus maintain the perimeter of the platform 19 spaced from the ring 49 throughout the entire circumference to prohibit heat leaks between these elements. The outer diameter of the tank 15 is typically less than two feet smaller than the inner diameter of the ring 49, and less than eight inches smaller than the distance between diametrically opposed spacer ribs 50.

After installation of the ring 49, spacers 50, padding 52 and flange 48, granular insulation material 21 such as perlite or vermiculite may be installed upon the floor 23 of the opening on top of the liner 13. This material 21 is initially filled to a depth approximating the top of the ring 49, typically two to five feet, which depth is shown by the dimension B in FIG. 3. Insulation is typically not placed outside the ring 49 at this time, so that workmen may stand outside of the ring 49 for the next construction phases.

Installation of the granular insulation material 21 throughout the floor area within the ring 49 is preferably accomplished in a manner which will assure equal density material 21 throughout. It will be understood by those skilled in the art that material, such as perlite, may vary in density in a supplier's storage facility, so that successive loads of material may gradually change density. By introducing successive loads into the excavation in a random pattern on the floor 23, or in a series of diametrically opposed locations, it is possible to average these density variations beneath the tank 15. Such averaging assures equal compaction of the material 21 beneath the platform 19 during loading and minimizes uneven settling of the tank 15.

When the area within the ring 49 is substantially filled with granular insulation material 21, the platform 19 may be lowered into the excavation, or fabricated in place.

The rigid or semirigid tank 15 is now lowered as a unit or in sections into the excavation to rest upon the platform 19. Both the tank 15 and the platform 19 therefore rest directly on the underlying layer of granular insulation material 21 without any additional supporting structure.

It will be understood that the tank 15 is typically fabricated in place, and that it may be convenient to initially construct only the lower portion of the tank 15. Thus, if the fluid to be used for preloading has a specific gravity which is twice that of the cryogenic liquid to be stored, only the lower half of the tank 15 must be complete prior to preloading.

After the lower section of the tank 15 is placed or built on the platform 19 and preloaded, mineral wool or other fibrous insulation 54 is packed between the ring 49 and the outer wall of the tank 15 above the platform 19. This insulation 54 is held in place by an annular flange 56 which is bolted or welded to the ring 49. The flange 56 surrounds the entire perimeter of the tank 15 and prohibits movement of the insulation 54. The flange 56 is spaced from the wall of tank 15 sufficiently to avoid contact therebetween during settling of the tank 15, so that no heat leak is created.

As stated above, one of the primary difficulties with supporting a tank 15 and its associated platform 19 directly upon granular insulation material 21 is the likelihood that during compaction, the insulation 21 will migrate from the space beneath the bottom 17 of the tank to the area between the cylindrical walls of the tank 15 and the excavation 11 so that the tank 15 will settle unevenly generating excessive stresses in the tank 15 and possible contacts with the excavation 11 which would permit excessive heat leaks. The arrangement described herein, however, will eliminate such migration since the ring 49 is spaced sufficiently close to the bottom 23 of the excavation 11, and the intervening annulus is closed by the insulation 54 and flange 56 to prohibit any appreciable migration.

Of primary importance in this installation is the fact that the granular insulation material 21 serves as the sole support for the platform 19, the tank 15, and fluid to be stored within the tank 15. It will be appreciated by those skilled in the art that granular insulation, such as perlite or vermiculite, is subject to compaction as well as migration during loading and unloading of the tank 15. Furthermore, the degree of compaction is particularly acute during the initial loading of the material. This compaction may be minimized by utilizing denser granular insulation 21 below the tank 15 than that used between the cylindrical wall of the tank 15 and the excavation 13, but may not be eliminated. Thus, in a typical installation, the insulation material 21 beneath the platform 19 will undergo an initial compaction during the first preload of the tank 15 in the order of 3–15%, so that the dimension B of FIG. 3 will be reduced by this percentage. A substantial part of this reduction in dimension will remain even after the initial preload is removed. On subsequent operations of unloading and again preloading the tank structure, the dimension B will be further reduced in diminishing degrees until it becomes minimal, and thus essentially stable regardless of repeated loadings and unloadings. It is therefore necessary to closely monitor the settling of the tank 15 during the initial three to five loading operations of the tank 15, and it is during these initial loadings that the ring 49 performs its essential purpose of prohibiting migration of granular material from beneath the platform 19. It will be recognized that during these initial preloads the platform 19 operates substantially as a piston within the cylindrical ring 49, compacting the granular insulating material 21. Since the space between the platform 19 and ring 49 is of relatively small cross-sectional area, and is filled with the insulation 54, and since the space between the bottom of the ring 49 and the bottom of the excavation 23 is filled with the padding 52, migration is essentially eliminated. The spacer ribs 50 prohibit any contact between the platform 19 and the ring 49 during this piston action which could create a serious heat leak within the system, and will prevent the widening of this space on one side of the platform 19 which would encourage migration of the insulation 21.

After the preloading operation is complete, the area between the cylindrical wall of the tank 15 and the excavation 11 is filled with granular insulation material, and the ceiling 27 and roof 33 are installed.

Figure 5:
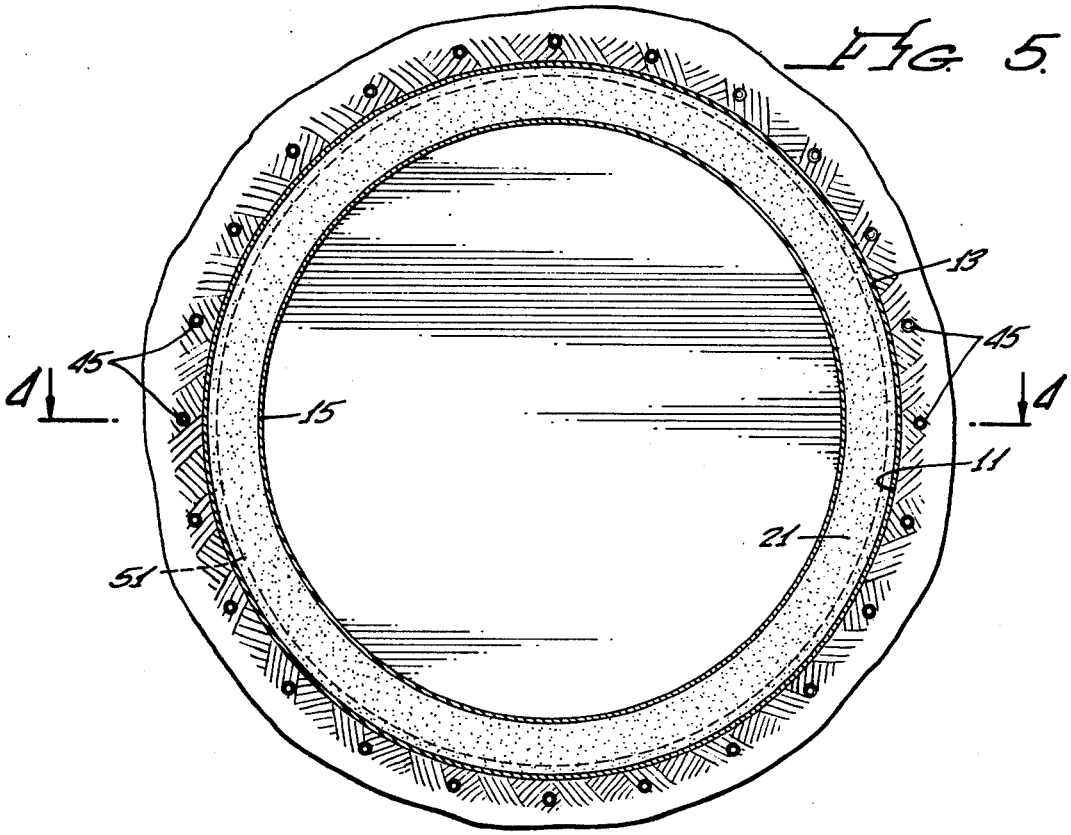
FIG. 5 is a horizontal sectional view similar to that of FIG. 2 taken along lines 5—5 of FIG. 4 showing the alternate embodiment of FIG. 4.
Figure 6:
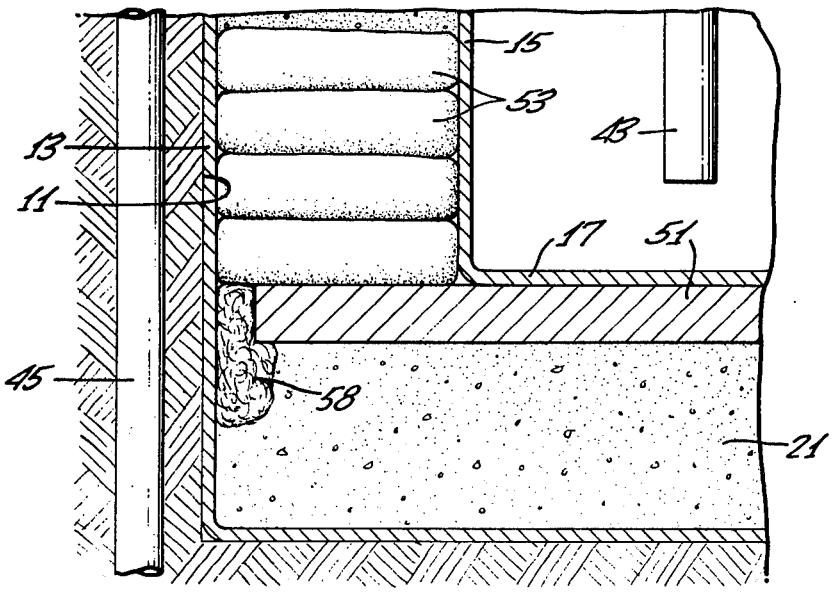
FIG. 6 is an enlarged portion of the sectional view of FIG. 4, similar to FIG. 3.

Referring now to FIGS. 4 through 6, an alternative support structure utilizing the essential features of the present invention will be described. The essential difference between the embodiments 4 through 6 and that described above is that the ring 49 is eliminated and the platform 51 underlying the tank 15 is brought into close proximity with the liner 13 and the wall of the excavation 11. In this instance, as shown in FIGS. 4 through 6, the tank 15 is constructed identical to the tank 15 of FIGS. 1 through 3 but the underlying platform 51 has a substantially larger diameter than the platform 19 of FIG. 1 and is also substantially larger than the bottom 17 of the tank 15. Due to the resulting extension of the edge of the platform 51 beyond the bottom of the tank 15, the platform 51 will typically require construction using metal or a substantially stronger insulating material than the platform 19 since substantial cantilever forces will be applied to the annular portion of the platform 51 adjacent the excavation wall 11. In a typical installation, the platform 51 is sized so that its perimeter lies close to the adjacent liner 13, but never touches the liner 13, typically five to twenty inches away, and this intervening annulus is packed with fibrous insulation such as mineral wool 58 to prohibit migration of insulating material 21 from beneath the platform 51 to the area between the sides of the container 15 and the excavation wall 11. As an additional assurance that the migration of material will not occur, granular insulation may be confined within bags 53 and placed immediately above the platform 51 around the tank 15 to hold the insulation 58 in place. As in the prior embodiment, any contact between the platform 51 and the excavation wall 11 would generate a substantial heat leak, and could possibly damage the liner 13.

In constructing the embodiment of FIGS. 4 through 6, the excavation 11 is first completed and the underlying layer of granular insulation 21 sufficient to support the platform 51 is placed in the bottom 23 of the excavation 11. The platform 51 is then lowered into the excavation or fabricated in place and centered within the walls of the excavation. The insulation 58 is then packed around the platform 51 and bags 53 are placed adjacent the platform 51. The remaining space between the rigid container 15 and the excavation walls are then filled with perlite and preloading may begin. Alternatively, preloading may be accomplished before the annular space between the cylindrical walls of the tank 15 and excavation 11 is filled. As with the prior embodiment, the layer of granular insulation 21 underlying the platform 51 is typically between two and five feet in thickness and is subject to precompression during initial loading which is substantial on the initial preloads and gradually reduces as multiple loading and unloading operations are completed.

With each of the embodiments described above, the essential features comprise the supporting of the tank 15 and its associated platform 19, 51 solely on a layer of granular insulation material 21 and the prohibition against migration of this granular material 21 which is accomplished through a reduction in the cross-sectional area between the area underlying the tank 15 and the area surrounding the cylindrical wall of the tank 15, as by the use of a cylindrical ring 49 adjacent the perimeter of the platform 19 or the placement of the platform 51 perimeter adjacent the excavation walls 11, and the filling of the reduced cross-sectional area with fibrous insulation material. In each instance, the linear dimension between the platform 19, 51 which operates as a piston and the ring 49 or excavation wall 11 which operates as a cylinder during compression is between one and ten inches, which dimension is large enough to prohibit substantial heat leaks but small enough to allow packing of fibrous insulation to prohibit substantial migration.

During the installation of either of the embodiments shown in FIGS. 1 through 6, steps may be taken to prohibit uneven settling of the platform 19 or 51 and a resulting canting of the container 15 within the excavation. Such canting is undesirable, since it increases the likelihood of heat leaks at certain points of the structure and may place undesirable stresses on the rigid tank 15. The uneven settling may occur as a consequence of a migration of the granular material 21 from one side to the other beneath the tank 15 or due to nonuniformity of the density of the granular material. Thus, before the roof 27 is placed on the tank structure, the initial preloads are accomplished, as by filling the tank 15 with water or other material sufficient to equal or exceed the ultimate cryogenic material load. During this preload operation, the position of the tank 15 is closely monitored by distance measuring gages to insure that the entire tank 15 settles uniformly within the excavation. For this purpose, a plurality of trusses or brackets 55, as shown in FIG. 1, may be rigidly mounted around the concrete ring 25. Measurements may be made between these brackets 55 and the top edge of the tank 15, either vertically or horizontally, either measurement giving an accurate indication of uneven settling. If, for example, the right side of the tank 15 as viewed in FIG. 1 is settling more than the left side during preloading of the tank 15, a cable such as the cable 57 may be connected between the right side of the tank 15 and the bracket 55 to support the right side of the tank 15. As additional preload fluid is added to the tank 15, the other side of the tank 15, the left side in FIG. 1, will continue to settle while the right side remains stationary due to supporting cable 57. When the tank 15 is again perfectly aligned within the excavation 11, the cable 57 may be removed and the tank may be permitted to continue settling until uneven settling again occurs. Each time such settling occurs, the bracket 55 adjacent the lowest portion of the tank 15 will be connected by a cable 57, or a single bracket 55 may be moved around the concrete 25 to the position where it is required.

Other well-known methods for relieving the weight from one side of the tank 15 may be utilized. Thus, for example, a crane may be attached to support one side of the tank 15 during the preloading operation, or multiple temporary beams may be placed across the ring 25 and selectively attached to the tank 15.

In order to give us complete understanding of the present invention as possible, typical measurements will now be given for the various elements within the storage tank structure. These measurements are given as exemplary only and the invention is seen as covering a broad range of tank sizes and types. In a typical installation, the diameter of the inner tank 15 will be between 40 and 200 feet, the thickness of the insulation 21 between the tank wall and the excavation sides and beneath the platform will be approximately three feet, the space between the platform 19 and ring 49, or between the platform 51 and excavation wall 11 will be approximately two inches, and the overall height of the excavation 11 will be approximately equal to the diameter of the excavation 11.

What is claimed is:

1. Apparatus for storing a cryogenic liquid comprising:

an outer structural vessel having a height and width in excess of 10 feet;

an inner structural vessel spaced from said outer structural vessel throughout its entire perimeter and bottom;

granulated compressible insulation material filling the void between said inner and outer vessels, said insulation being the sole means of support of said inner vessel; and means for prohibiting migration of said granulated insulation material from beneath said inner structural vessel to the sides thereof.

2. Apparatus for storing a cryogenic liquid as defined in claim 1 wherein said means for prohibiting migration comprises:

a platform beneath said inner vessel resting on said granulated compressible insulation material, said platform extending horizontally beyond said inner vessel substantially throughout the perimeter thereof.

3. Apparatus for storing a cryogenic liquid as defined in claim 2 wherein said platform extends to within ten inches of said outer vessel throughout the perimeter thereof.

4. Apparatus for storing a cryogenic liquid comprising:

an outer structural vessel having a height and width in excess of 10 feet;

an inner structural vessel spaced from said outer structural vessel throughout its entire perimeter and bottom;

granulated insulation material filling the void between said inner and outer vessels, said insulation being the sole means of support of said inner vessel; and means for prohibiting migration of said granulated insulation material from beneath said inner structural vessel to the sides thereof, said means for prohibiting migration comprising:

a platform beneath said inner vessel resting on said granulated insulation material, said platform extending horizontally beyond said inner vessel substantially throughout the perimeter thereof; and a rigid cylindrical ring spaced by padding above the bottom of said outer structural vessel, said ring extending above said platform and horizontally spaced from said platform by less than ten inches throughout the perimeter thereof.

5. Apparatus for storing a cryogenic liquid as defined in claim 1 wherein said outer structural vessel comprises an excavation in the earth's surface having frozen walls.

6. Apparatus for storing a cryogenic liquid as defined in claim 1 wherein said outer structural vessel comprises a cylindrical structure fabricated above the earth's surface.

7. Apparatus for storing a cryogenic liquid as defined in claim 1 wherein said means for prohibiting migration comprises:

an impediment spaced from said outer vessel, said impediment reducing the area between said inner and outer vessels at the junction of the bottom and side walls of said inner vessel to impede the movement of said insulation material.

8. Apparatus for storing a cryogenic liquid comprising:

an outer structural vessel having a height and width in excess of 10 feet;

an inner structural vessel spaced from said outer structural vessel throughout its entire perimeter and bottom;

granulated insulation material filling the void between said inner and outer vessels, said insulation being the sole means of support of said inner vessel; and means for prohibiting migration of said granulated insulation material from beneath said inner structural vessel to the sides thereof, said means for prohibiting migration comprising:

an impediment spaced from said outer vessel, said impediment reducing the area between said inner and outer vessels at the junction of the bottom and side walls of said inner vessel to impede the movement of said insulation material; and spacer means for holding said impediment equally spaced from said inner vessel throughout the perimeter thereof.

9. Apparatus for storing a cryogenic liquid as defined in claim 1 wherein said granulated insulation material is perlite.

10. A method of fabricating a storage vessel having a height and width in excess of 10 feet for the storage of a liquefied gas, comprising:

forming an outer structural vessel having a bottom and side walls;

placing granulated compressible insulation material on the bottom of said structural vessel;

resting a platform solely on said granulated insulation material;

resting an inner structural vessel which is smaller in height and width than said outer structural vessel solely on said platform spaced from the side walls of said outer structural vessel; and filling the area between said inner structural vessel and the side walls of said outer structural vessel with granulated compressible insulation material.

11. A method of fabricating a storage vessel as defined in claim 10 wherein said outer structural vessel forming step comprises:

freezing a cylindrical wall beneath the earth's surface; and excavating the earth within said cylindrical frozen wall.

12. A method of fabricating a storage vessel as defined in claim 10 wherein said outer structural vessel forming step comprises:

constructing said vessel above the earth's surface.

13. A method of fabricating a storage vessel having a height and width in excess of 10 feet for the storage of a liquefied gas, comprising:

forming an outer structural vessel having a bottom and side walls;

placing granulated insulation material on the bottom of said structural vessel;

resting a platform solely on said granulated insulation material;

placing an inner structural vessel which is smaller in height and width than said outer structural vessel on said platform spaced from the side walls of said outer structural vessel;

filling the area between said inner structural vessel and the side walls of said outer structural vessel with granulated insulation material; and resting a ring surrounding the bottom of said inner structural vessel but spaced from said inner vessel on the floor of said outer vessel to act as a migration impediment for said granulated insulation material.

14. A method of fabricating a storage vessel as defined in claim 10 additionally comprising:

preloading said inner structural vessel;

measuring the relative positions of said inner and outer vessels during said preloading step to measure uneven settling of said inner vessel and uneven compression of said granulated compressible insulation material; and temporarily supporring one side of said inner vessel during said preloading step to assure even settling thereof.

15. Apparatus for storing a cryogenic liquid comprising:

an inner structural vessel spaced from said outer structural vessel throughout its entire perimeter and bottom; and bulk granulated compressible insulation material filling the void between said inner and outer vessels, said insulation being the sole means of support of said inner vessel.

16. Apparatus for storing a cryogenic liquid comprising:

an outer structural vessel having a height and width in excess of 10 feet;

an inner structural vessel spaced from said outer structural vessel throughout its entire perimeter and bottom; and bulk granulated compressible insulation material filling the void between said inner and outer vessels, said insulation being the principal means of support of said inner vessel.

* * * * *